US010526176B2

(12) United States Patent
Kobatake

(10) Patent No.: US 10,526,176 B2
(45) Date of Patent: Jan. 7, 2020

(54) CRANE ASSEMBLING METHOD

(71) Applicant: KOBELCO CONSTRUCTION MACHINERY CO., LTD., Hiroshima-shi (JP)

(72) Inventor: Tetsuya Kobatake, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 16/214,579

(22) Filed: Dec. 10, 2018

(65) Prior Publication Data

US 2019/0185297 A1 Jun. 20, 2019

(30) Foreign Application Priority Data

Dec. 18, 2017 (JP) ..... 2017-242108

(51) Int. Cl.
*B66C 23/34* (2006.01)
*B66C 23/42* (2006.01)
(Continued)

(52) U.S. Cl.
CPC ..... *B66C 23/34* (2013.01); *B66C 23/42* (2013.01); *B66C 23/70* (2013.01); *B66C 23/702* (2013.01); *B66C 23/82* (2013.01)

(58) Field of Classification Search
CPC ..... B66C 23/34; B66C 23/00; B66C 23/06; B66C 23/18; B66C 23/26; B66C 23/42;
(Continued)

(56) References Cited

U.S. PATENT DOCUMENTS 3,083,837 A * 4/1963 Jones ..... B66C 23/26 212/295
3,263,383 A * 8/1966 Foster ..... B66C 23/62 52/143

(Continued)

FOREIGN PATENT DOCUMENTS

JP 10-194677 A 7/1998
JP 2008-81242 4/2008

(Continued)

OTHER PUBLICATIONS

Machine Translation of JP 2012116607 (Year: 2012).*
Extended European Search Report dated May 6, 2019 in European Patent Application No. 18211224.3, 6 pages.

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

Provided is a crane assembling method which can easily assemble a crane. In the crane assembling method, a step of connecting an (n+1)th partial jib includes the steps of: placing a distal end of an nth partial jib connected to a boom on a pedestal on the ground; connecting an upper side connector on a proximal end of the (n+1)th partial jib to an upper side connector on the distal end of the nth partial jib in a state where the (n+1)th partial jib is lifted; mounting a wheel on the lower side connector on a distal end of the (n+1)th partial jib; and connecting a lower side connector of the nth partial jib and a lower side connector on a proximal end of the (n+1)th partial jib to each other by lifting the nth partial jib.

4 Claims, 13 Drawing Sheets

(51) Int. Cl.
*B66C 23/70* (2006.01)
*B66C 23/82* (2006.01)

(58) Field of Classification Search
CPC ..... B66C 23/62; B66C 23/68; B66C 23/70; B66C 23/702
USPC ..... 212/270
See application file for complete search history.

(56) References Cited

U.S. PATENT DOCUMENTS 3,306,470 A * 2/1967 Green ..... B66C 23/70 212/300
3,794,184 A * 2/1974 Higgins ..... B66C 23/34 212/295
3,945,333 A 3/1976 Fritsch et al.
6,062,405 A * 5/2000 Pech ..... B66C 23/36 212/298
6,481,202 B1 * 11/2002 Zuehlke ..... B66C 23/36 212/299
7,270,243 B2 * 9/2007 Diehl ..... B66C 23/82 212/270
2009/0127219 A1 * 5/2009 Willim ..... B66C 23/82 212/300
2009/0134108 A1 * 5/2009 Willim ..... B66C 23/82 212/270
2010/0213152 A1 * 8/2010 Martin ..... B66C 23/18 212/177
2010/0276385 A1 * 11/2010 Pech ..... B66C 23/348 212/237
2014/0083964 A1 * 3/2014 Kurotsu ..... B66C 23/66 212/177
2014/0263140 A1 * 9/2014 Inada ..... B66C 23/70 212/177
2016/0221799 A1 * 8/2016 Muench ..... B66C 13/18
2018/0065833 A1 * 3/2018 Stoof ..... B66C 23/74

FOREIGN PATENT DOCUMENTS

JP 2012-116607 A 6/2012
JP 2014-65573 A 4/2014

* cited by examiner

CRANE ASSEMBLING METHOD

TECHNICAL FIELD

The present invention relates to a crane assembling method.

BACKGROUND ART

Conventionally, there has been known a crane such as a luffing jib crane which includes a jib on a distal end of a boom or a tower crane. In such a large-sized crane having the jib, the jib has the split structure formed of a plurality of parts (partial jibs). In a site where the crane is used, the jib is assembled by connecting partial jibs to each other.

In general, the large-sized crane is assembled in a state where the crane is laid down on a ground such that the boom and the jib extend on one straight line (so called "lying-type assembly method"). However, in such a lying-type assembly method, it is necessary to ensure a space elongated in a horizontal direction so that the boom and the jib can be extended horizontally. However, when the large-sized crane is used, there is a possibility that it is impossible to ensure a sufficient space which allows the adoption of the lying-type assembly method in a work site.

In the case where a sufficient space cannot be ensured so that the lying-type assembly method cannot be adopted in assembling a crane, a method referred to as a "standing-type assembly method" is adopted where a jib is mounted on a boom in a state that the boom is raised. For example, JP-A-2008-81242 describes a crane assembling method where partial jibs are sequentially connected one by one to a distal end of a boom to assemble a crane.

In the crane assembling method of a crane described in the above-mentioned publication, firstly, the boom is mounted on a crane body, and a base end jib (a partial jib connected to the boom) is connected to a distal end of the boom laid down on a ground. Then, an upper side portion of a distal end of the base end jib and an upper side portion of a proximal end of an intermediate jib (a partial jib other than both ends) placed on the ground are joined to each other by a pin so that a temporary connection state is brought about where the intermediate jib is bent toward a back side (upper side) with respect to the base end jib. Next, ropes are extended between a strut supported on the boom above the base end jib and both ends of the intermediate jib. By raising the boom in a state where the intermediate jib is held horizontally, the boom is lifted in air while maintaining the temporary connection state where the base end jib and the intermediate jib are bent. Then, by slackening the above-mentioned ropes which hold the intermediate jib, the intermediate jib rotates relative to the base end jib due to its own weight. Then, by joining a lower side portion of a distal end of the base end jib and a lower side portion of a proximal end of the intermediate jib to each other by a pin, the intermediate jib is connected to the base end jib such that the intermediate jib extends straight with respect to the base end jib. At this stage of operation, to prevent the base end jib from excessively sagging downward more than a fixed angle with respect to the distal end of the boom, the crane described in the publication includes a back stop cylinder on a distal end portion of the boom. The back stop cylinder connects the distal end portion of the boom and the base end jib to each other thus preventing lowering of the base end jib.

The crane assembling method described in the above-mentioned publication is applicable to only a special crane which includes the back stop cylinder for preventing sagging of the base end jib.

Further, in the case of assembling a large-sized crane having a jib in a narrow space, a method is also considered where an upper side portion of a distal end of a base end jib and an upper side portion of a proximal end of an intermediate jib placed on a ground are joined to each other by a pin, both ends of the intermediate jib are separately lifted, and the intermediate jib is connected to the base end jib in a straight posture. However, such a method requires a sophisticated crane operating technique, and requires a particular attention for ensuring safety.

SUMMARY OF INVENTION

The present invention has been made in view of the above-mentioned circumstances, and it is an object of the present invention to provide a crane assembling method which can easily assemble a large-sized crane having a jib.

To achieve the above-mentioned object, the present invention provides a crane assembling method of assembling a crane, the crane including: a crane body; a boom which is disposed on the crane body such that the boom is capable of being raised or laid down about a first rotary shaft which is disposed horizontally; a jib which is connected to a distal end of the boom such that the jib is capable of being raised or laid down about a second rotary shaft which is disposed horizontally, the jib being formed by connecting a plurality of partial jibs to each other in a longitudinal direction. The crane assembling method includes a partial jib connecting step of connecting an (n+1)th partial jib to a distal end of an nth partial jib, where n is a natural number, in a state where the boom is mounted on the crane body and is laid down and n pieces of the partial jibs are connected to the distal end of the boom. The partial jib connecting step includes a placing step, an upper side connector connecting step, a wheel mounting step, and a lower side connector connecting step. In the placing step, the distal end of the boom is separated upward from a ground, and a distal end of the nth partial jib connected to the boom is placed on the ground or a pedestal disposed on the ground. In the upper side connector connecting step, the (n+1)th partial jib is lifted and is moved near to the nth partial jib, and an upper side connector disposed on an upper side portion of a distal end of the nth partial jib and an upper side connector disposed on an upper side portion of a proximal end of the (n+1)th partial jib are connected to each other by a fixing pin which extends parallel to the second rotary shaft in a relatively rotatable manner. In the wheel mounting step, in a state where the (n+1)th partial jib is lifted, a wheel capable of rolling on the ground is mounted on a lower side connector disposed on a lower side portion of a distal end of the (n+1) partial jib. In the lower side connector connecting step, the nth partial jib is lifted using the second rotary shaft as a fulcrum so that the (n+1)th partial jib is rotated relative to the nth partial jib about the fixing pin while allowing rolling of the wheel on the ground, the lower side connector disposed on the lower side portion of the proximal end of the (n+1)th partial jib is moved near to the lower side connector disposed on the lower side portion of the distal end of the nth partial jib, and the lower side connector on the distal end of the nth partial jib and the lower side connector on the proximal end of the (n+1)th partial jib are connected to each other.

DESCRIPTION OF EMBODIMENTS

Hereinafter, an embodiment of the present invention is described with reference to drawings as appropriate.

[Crane]

Figure 1:
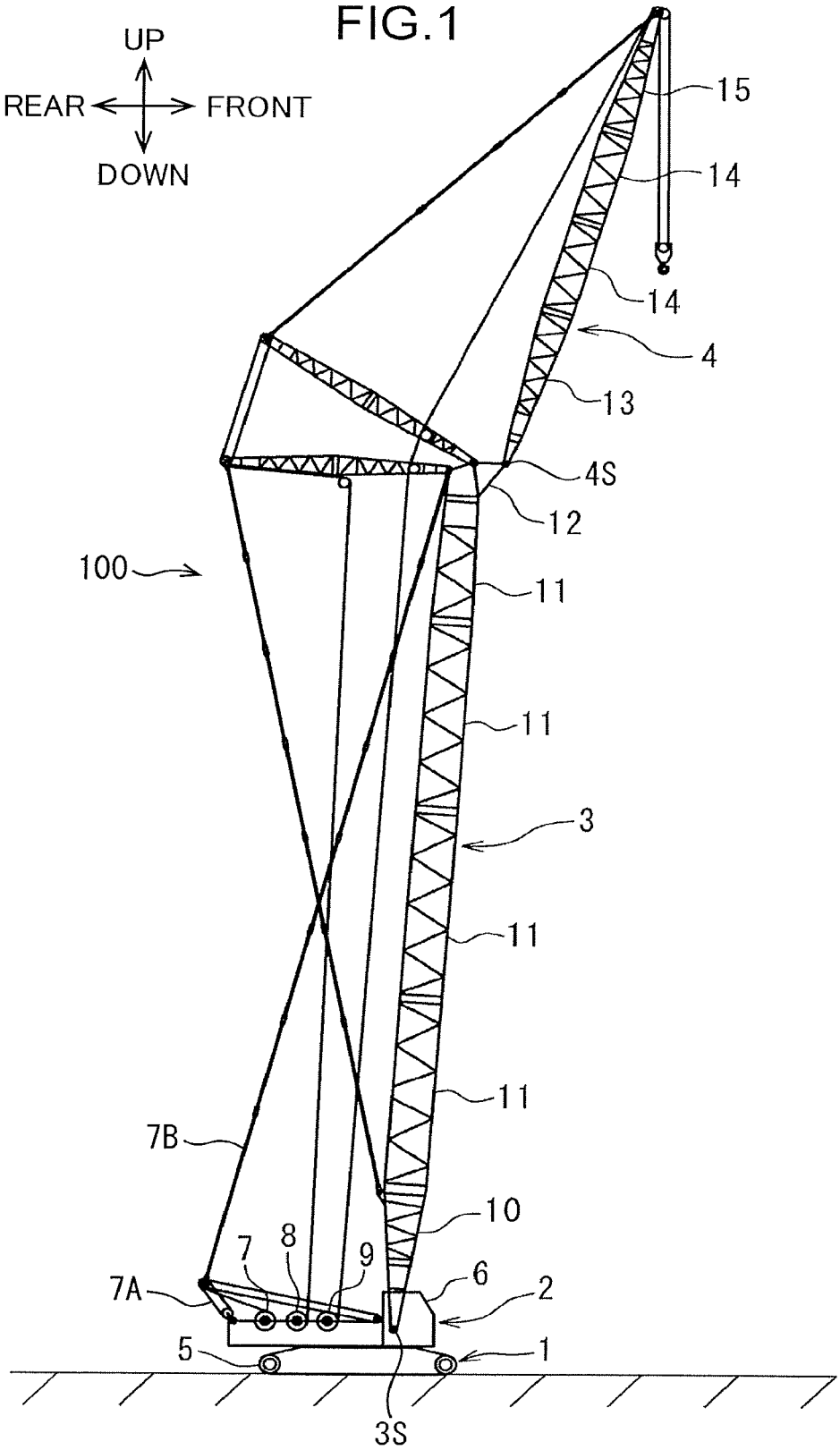
FIG. 1 is a side view schematically showing a crane which is assembled by a crane assembling method of a crane according to one embodiment of the present invention.

FIG. 1 shows the configuration of a crane 100 which is assembled by an assembling method (also referred to as a standing-type assembly method) of a crane according to one embodiment of the present invention.

The crane 100 is a luffing jib crane which includes: a lower traveling body 1; an upper turning body 2 (crane body) which is mounted on the lower traveling body 1 in a horizontally turnable manner; a boom 3 which is disposed on a front portion of the upper turning body 2 so as to be raised or laid down in a frontward and rearward direction (in a swingable manner such that the boom 3 is laid down in a frontward direction and is raised in a rearward direction); and a jib 4 which is connected to a distal end of the boom 3 so as to be capable of being raised or laid down in the frontward and rearward direction.

[Lower Traveling Body]

The lower traveling body 1 includes a pair of left and right crawlers (crawler belts) 5 as a traveling device.

[Upper Turning Body]

The upper turning body 2 includes: an operator's cabin 6; a boom raising winch 7 for raising the boom 3; a jib raising winch 8 for raising the jib 4; a winding winch 9 which is suspended from a distal end of the jib 4 and winds a rope for lifting a suspended load; and the like.

[Boom]

The boom 3 is formed by connecting a lower boom 10, a plurality of intermediate booms 11 and a tower cap 12 to each other in this order in a longitudinal direction of the boom 3. The lower boom 10 is mounted on the upper turning body 2. The jib 4 is connected to the tower cap 12. The lower boom 10 and the plurality of intermediate booms 11 respectively have the lattice structure where four main girders (columns) and a plurality of auxiliary girders (lattices) which connect the neighboring main girders to each other are provided so as to form an approximately rectangular cylindrical framework structural body. The boom 3 is configured to be raised or laid down using, as a fulcrum, a boom foot 3S disposed on a proximal end of the boom 3. The boom foot 3S forms a horizontal rotary shaft (first rotary shaft).

[Jib]

The jib 4 is formed by connecting a plurality of partial jibs (a lower jib 13, a plurality of intermediate jibs 14 and an upper jib 15) to each other along a longitudinal direction of the jib 4. The lower jib 13 is connected to a distal end of the boom 3. These partial jibs respectively have a lattice structure where four main girders (columns) and a plurality of auxiliary girders (lattices) which connect the neighboring main girders to each other are provided so as to form an approximately rectangular cylindrical or a quadrangular pyramid-shaped framework structural body. The jib 4 is configured to be raised or laid down using a jib foot 4S disposed on a proximal end of the jib 4 as a fulcrum. The jib foot 4S forms a horizontal rotary shaft (second rotary shaft) parallel to the first rotary shaft.

Figure 2:
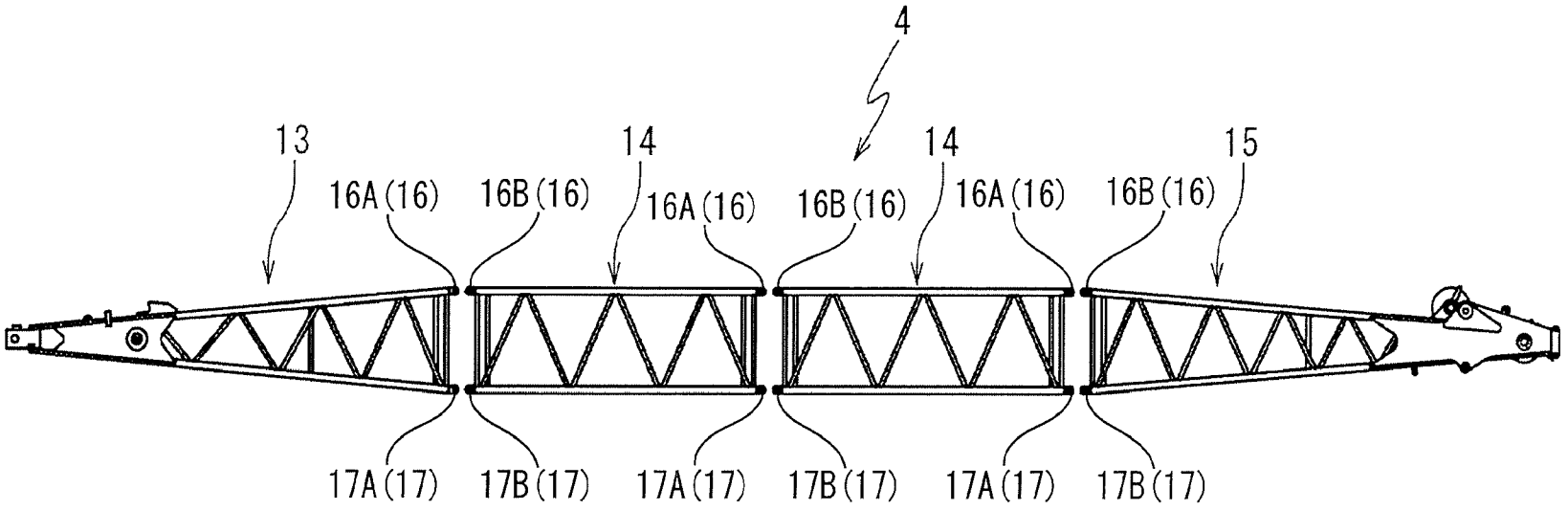
FIG. 2 is an exploded side view schematically showing a configuration of a jib of the crane shown in FIG. 1.
Figure 3:
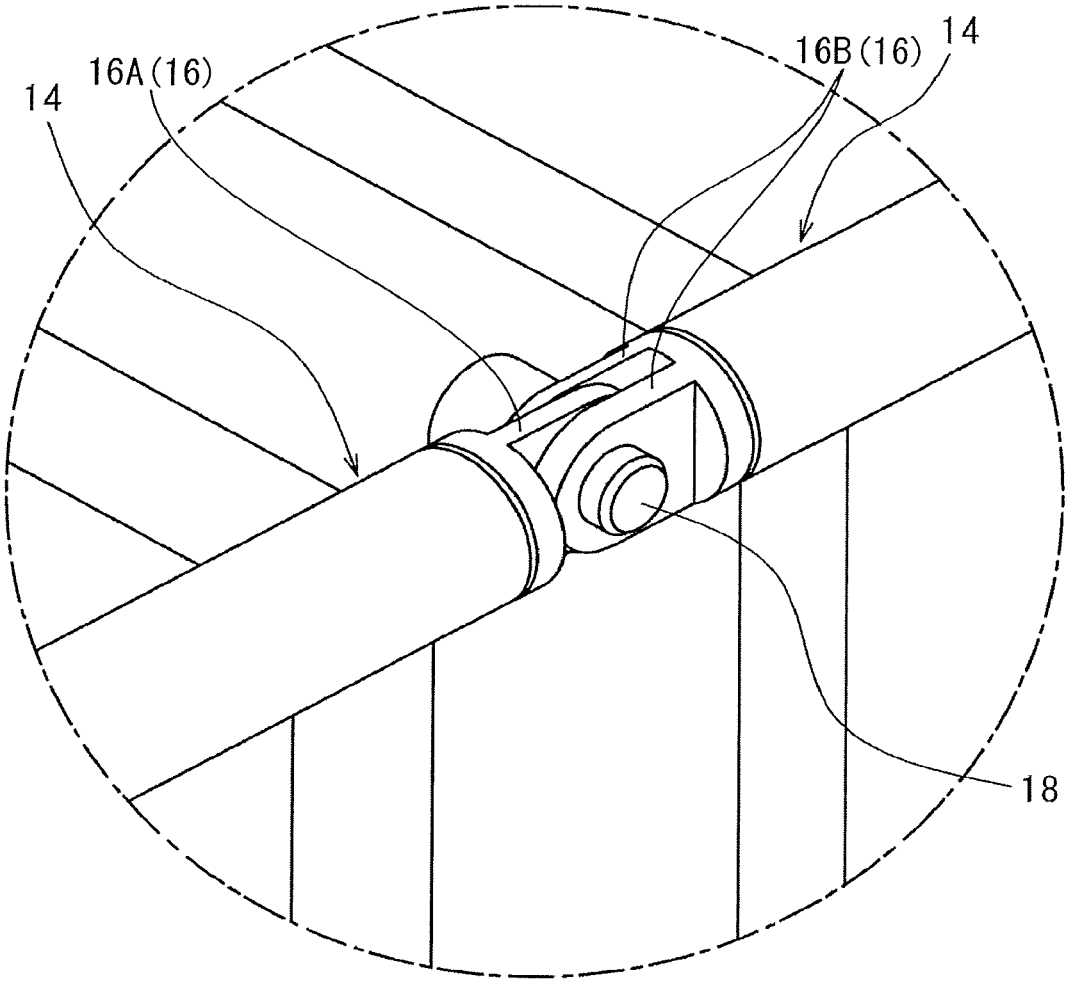
FIG. 3 is an enlarged perspective view schematically showing a connector of the jib shown in FIG. 2.
Figure 4:
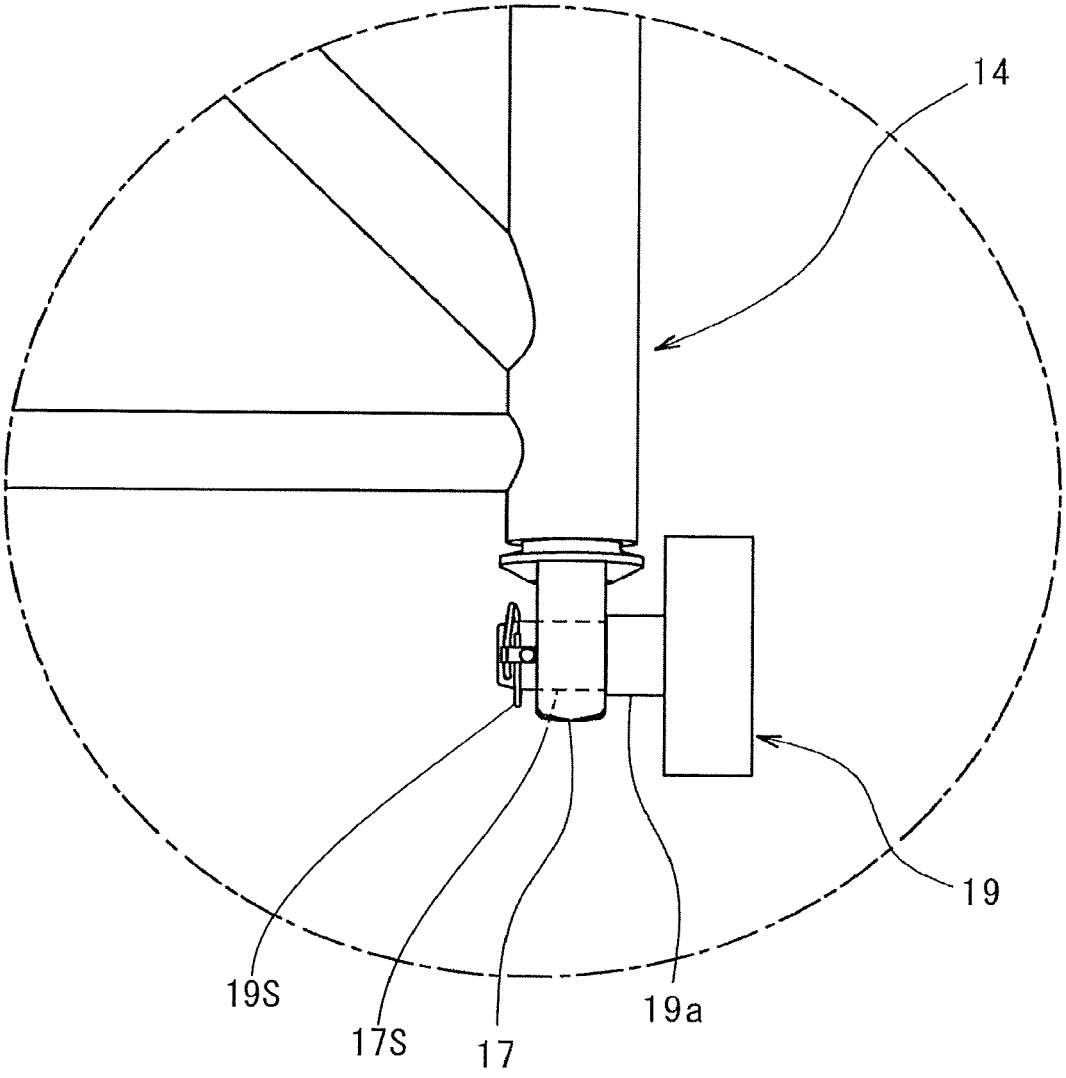
FIG. 4 is an enlarged bottom plan view schematically showing a mounting state of a wheel to the connector shown in FIG. 2.

FIG. 2 is an exploded side view schematically showing the configuration of the jib 4 of the crane 100 shown in FIG. 1. FIG. 3 is an enlarged perspective view schematically showing a connector 16 of the jib 4 shown in FIG. 2. FIG. 4 is an enlarged bottom plan view schematically showing a mounting state of a wheel 18 on a connector 17 shown in FIG. 2.

As shown in detail in FIG. 2, the partial jibs respectively include: the back-side connector 16 and the front-side connector 17 which are provided in a protruding manner along the longitudinal direction of the jib 4 on a back side (an upper side in a laid down posture shown in FIG. 2) and an front side (a lower side in the laid down posture) of end portions of the partial jib at which the partial jibs are connected to each other (a distal end of the lower jib 13, both ends of the respective intermediate jibs 14, a proximal end of the upper jib 15). In FIG. 2, the back-side connectors 16 and the front-side connectors 17 are disposed on a viewer's side of a paper surface on which FIG. 2 is depicted and a depth side of the paper surface on which FIG. 2 is depicted respectively. As shown in FIG. 3 in more details, these partial jibs are connected to each other by inserting fixing pins 18 in the back-side connectors 16 (upper side connector) and the front-side connector 17 (lower side connectors) in a direction parallel to axes for raising or lying down the partial jibs, that is, in a horizontal direction. Accordingly, a pin hole not shown in the drawing is formed in the back-side connectors 16 along a lateral direction, and a pin hole 17S (FIG. 4) is formed in the front-side connectors 17 along the lateral direction. Further, as shown in FIG. 4, a wheel 19 can be mounted on the front-side connector 17.

(Connector)

The back-side connector 16 and the front-side connector 17 can be formed of one or a plurality of plate-like bodies which are formed in a projecting manner in the longitudinal direction from an end portion of the main girder of the partial jib. The back-side connectors 16 which are connected to each other and the front-side connectors 17 which are connected to each other are disposed in a displaced manner such that the connected back-side connectors 16 and the front-side connectors 17 are disposed adjacently to each other in the horizontal direction respectively. Further, it is preferable that at least one of the pair of back-side connectors 16 which is connected to each other and at least one of the pair of front-side connectors 17 which is connected to each other be respectively formed of a plurality of plate-like bodies (see the connectors 16B in FIG. 2 and FIG. 3, and the connectors 17B in FIG. 2) which are formed in a protruding manner and in a spaced apart manner in the horizontal direction, and the other of the pair of back-side connectors 16 and the other of pair of front-side connectors 17 (see the connectors 16A in FIG. 2 and FIG. 3, and the connectors 17A in FIG. 2) be fitted in between the plurality of plate-like bodies.

(Wheel)

The wheel 19 has a shaft 19*a* (wheel rotary shaft) which is inserted into a hole (pin hole) of the front-side connector 17 into which the fixing pin 18 is inserted, and rotates about the shaft 19*a*. Accordingly, the shaft 19*a* is preferably provided with a bearing, a bushing or the like interposed between the shaft 19*a* and the hole, for example. Further, the shaft 19*a* is preferably be configured such that a retainer 19S (FIG. 4) such as a pin or a retaining ring, for example, can be mounted on a distal end portion of the shaft 19*a* which penetrates the front-side connector 17 and protrudes from the front-side connector 17, for example. Actually, the pair of left and right wheels 19 is respectively mounted on the pair of left and right front-side connectors 17.

[Assembling Method of Crane]

In the crane assembling method of a crane according to one embodiment of the present invention, the boom 3 is assembled to the upper turning body 2 and, thereafter, the jib 4 is assembled by sequentially connecting the partial jibs to the distal end of the boom 3 one by one. FIG. 5 to FIG. 12 are side views respectively schematically showing one step of the crane assembling method of the crane 100 according to this embodiment. The assembling of the crane 100 is performed in the order of operations shown in FIG. 5 to FIG. 12.

The crane assembling method of a crane includes the steps of: assembling the boom 3 to the upper turning body 2 [boom assembling step]; connecting the lower jib 13 to a distal end of the boom 3 in a state that the lower jib 3 can be raised or laid down [lower jib connecting step]; connecting the intermediate jib 14 to the lower jib 13 or connecting another intermediate jib 14 to the most distal end of one or a plurality of intermediate jibs 14 connected to the lower jib 13 [intermediate jib connecting step]; and connecting the upper jib 15 to the most distal end of the plurality of intermediate jibs 14 connected to the lower jib 13 [upper jib connecting step]. The intermediate jib connecting step is repeated plural times corresponding to the number of intermediate jibs 14.

[Boom Assembling Step]

In the same manner as the usual lying-type assembly method, in the boom assembling step, the boom 3 is assembled in a state where the boom 3 is laid down on a ground, and is mounted on the upper turning body 2. Alternatively, the lower boom 10 may be mounted on the upper turning body 2 and, thereafter, the plurality of intermediate booms 11 and the tower cap 12 may be mounted on the lower boom 10 sequentially.

[Lower Jib Connecting Step]

Figure 5:
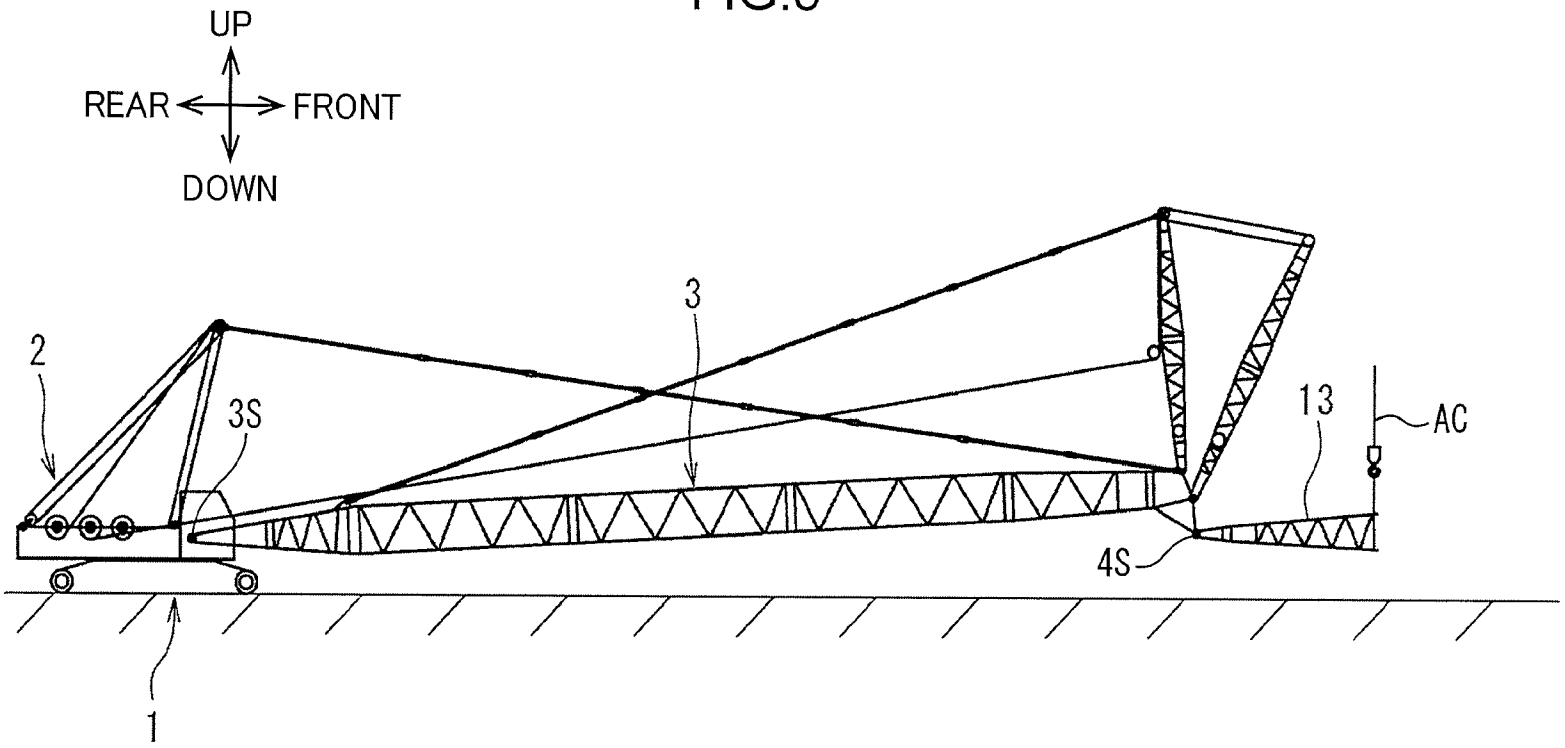
FIG. 5 is a side view schematically showing a step of the crane assembling method of a crane according to one embodiment of the present invention.

In the lower jib connecting step, the lower jib 13 is mounted on a distal end of the boom 3 using an assembling crane AC (FIG. 5). It is preferable that the lower jib connecting step be performed in a state where the distal end of the boom 3 is slightly lifted so as to perform the mounting of the lower jib 13 in a state where the lower jib 13 is lifted in a horizontal posture.

[Intermediate Jib Connecting Step]

The intermediate jib connecting step (partial jib connecting step) is a step where, assuming that the number of partial jibs are expressed by natural number n where the lower jib 13 is counted as the first partial jib, the boom 3 is laid down simultaneously with the mounting of the boom 3 on the upper turning body 2, and in a state where n pieces of the partial jibs (the lower jib 13 or the lower jib 13 and one or a plurality of intermediate jibs 14) are connected to the distal end of the boom 3, an (n+1)th partial jib (another intermediate jib 14) is connected to a distal end of an n-th partial jib (the lower jib 13 or the intermediate jib 14 on a most distal end side out of the intermediate jibs 14 connected to the lower jib 13).

The intermediate jib connecting step (a step of connecting the (n+1)th partial jib) includes the steps of: placing a distal end of an n-th partial jib connected to the boom 3 on a pedestal S disposed on the ground in a state where the distal end of the boom 3 is separated from the ground in the upward direction <placing step>; connecting the back-side connector 16 on a proximal end side of the (n+1)th partial jib to the back-side connector 16 on a distal end side of the n-th partial jib in a state where the (n+1)th partial jib is lifted <back-side connector connecting step (upper side connector connecting step)>; mounting the wheel 19 on the front-side connector 17 on a distal end side of the (n+1)th partial jib <wheel mounting step>; and connecting the front-side connector 17 on a distal end side of n-th partial jib and the front-side connector 17 on a proximal end side of the (n+1)th partial jib to each other <front-side connector connecting step (lower side connector connecting step)>.

It is more preferable that the intermediate jib connecting step further include a step of moving a distal end of the (n+1)th partial jib close to a position where the distal end of the n-th partial jib is placed in the back-side connector connecting step of connecting the back-side connector on a proximal end side of the (n+1)th partial jib by raising the boom 3 <a moving step or a distal end moving step> after the front-side connector connecting step, for the next intermediate jib connecting step or the upper jib connecting step.

Figure 11:
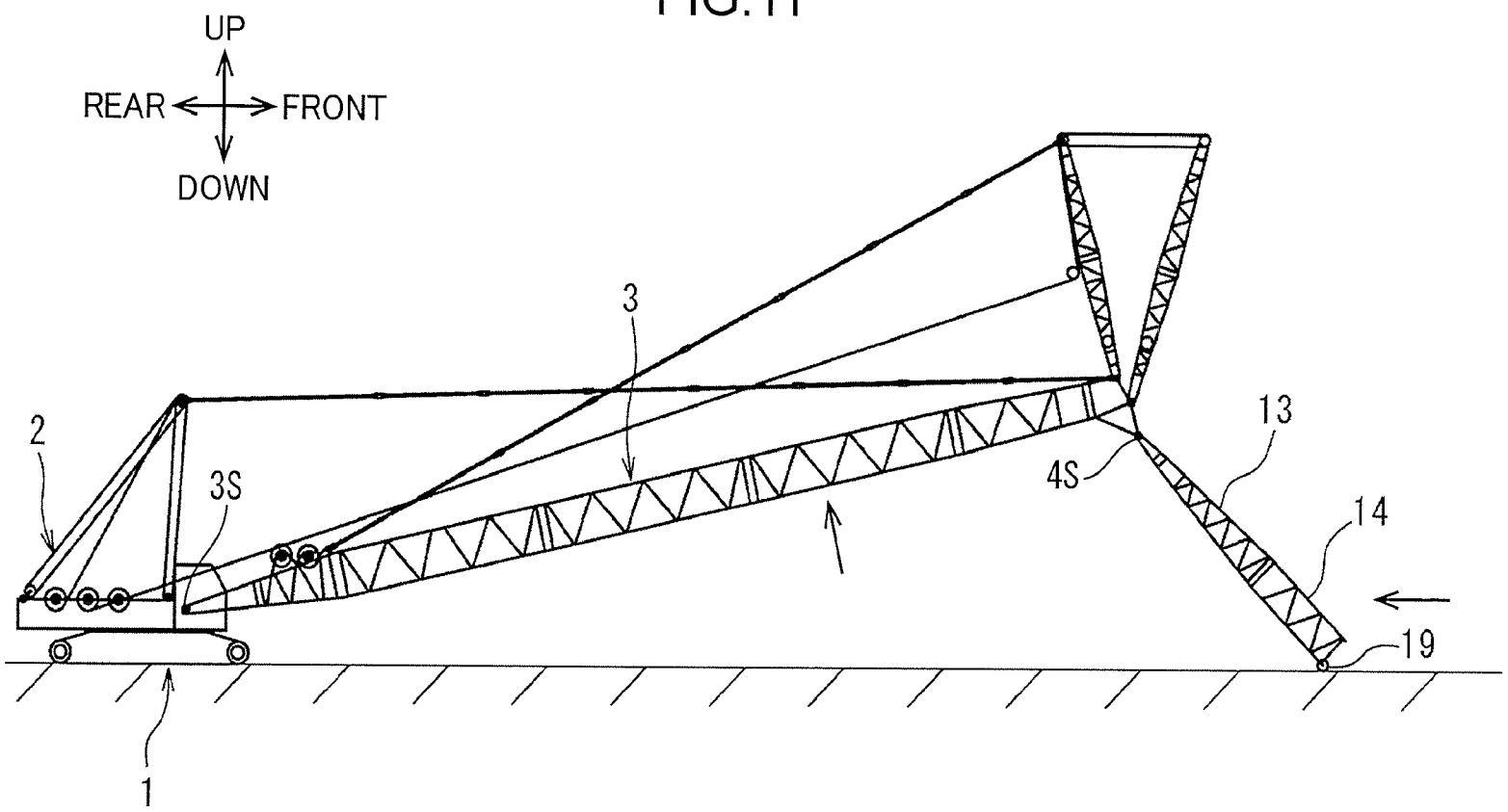
FIG. 11 is a side view schematically showing a step succeeding to the step shown in FIG. 10 of the crane assembling method of a crane according to one embodiment of the present invention.
Figure 12:
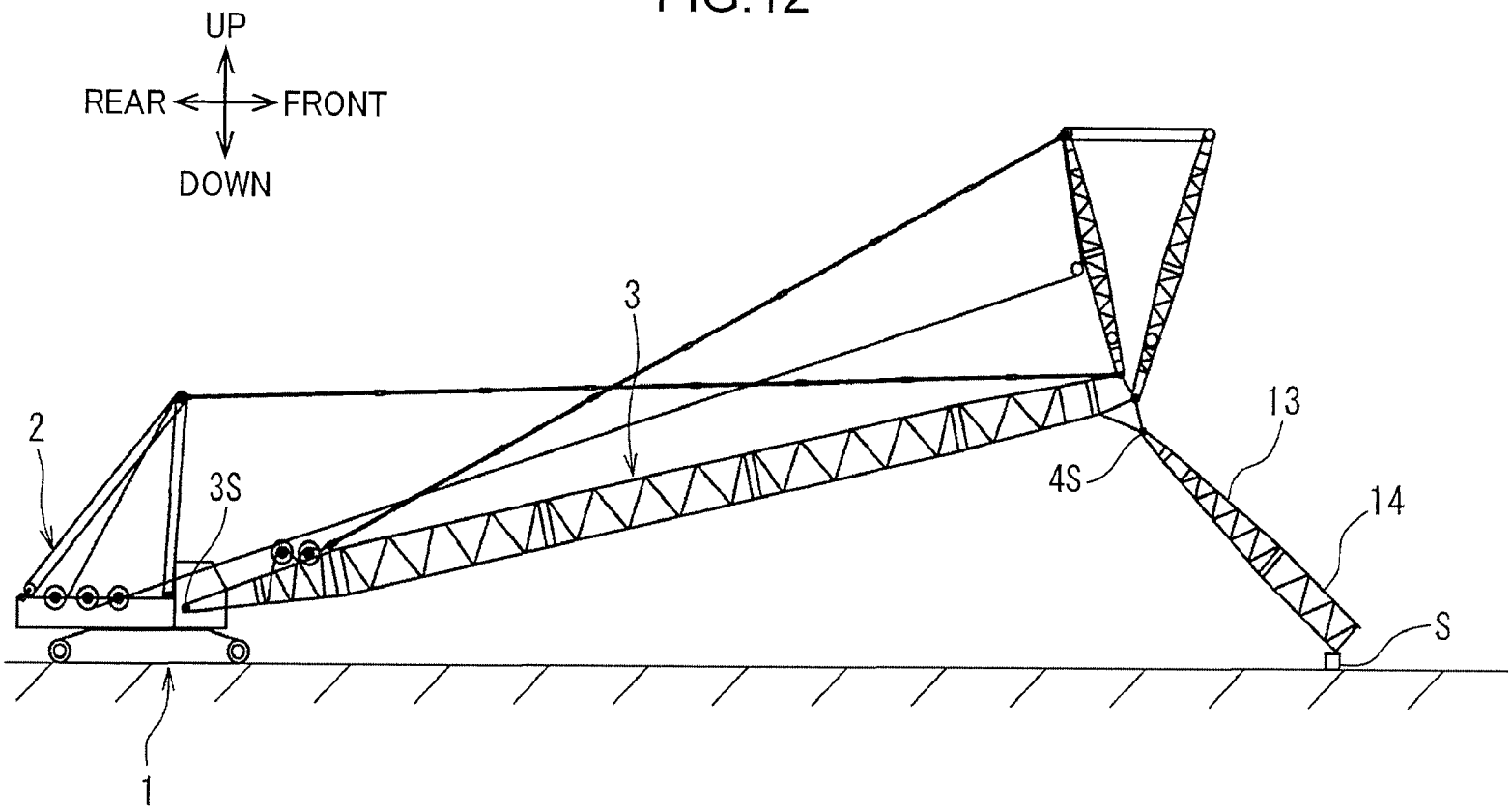
FIG. 12 is a side view schematically showing a step succeeding to the step shown in FIG. 11 of the crane assembling method of a crane according to one embodiment of the present invention.

Hereinafter, the intermediate jib connecting step is described in more detail. In FIG. 5 to FIG. 10, assuming that the number of partial jibs are expressed by natural number n, the state is shown where, to the lower jib 13 which corresponds to the first partial jib (n=1), intermediate jib 14 which corresponds to the second partial jib is connected. FIG. 11 and FIG. 12 show the preparation (a moving step, a placing step) for connecting the second-stage intermediate jib 14 (third-stage partial jib) to the lowermost-stage intermediate jib 14 (second partial jib) connected to the lower jib 13 (n=2).

<Placing Step>

In the placing step, firstly, as shown in FIG. 5, a state is brought about where the distal end of the boom 3 is separated from the ground by slightly raising the boom 3 while lifting the distal end portion of the lower jib 13 (first partial jib) using the assembling crane AC. To raise the boom 3, an operation of winding a rope 7A (FIG. 1) is performed by a boom raising winch 7. As a result, the distal end portion of the boom 3 is towed toward the upper turning body 2 through a guide line 7B.

Figure 6:
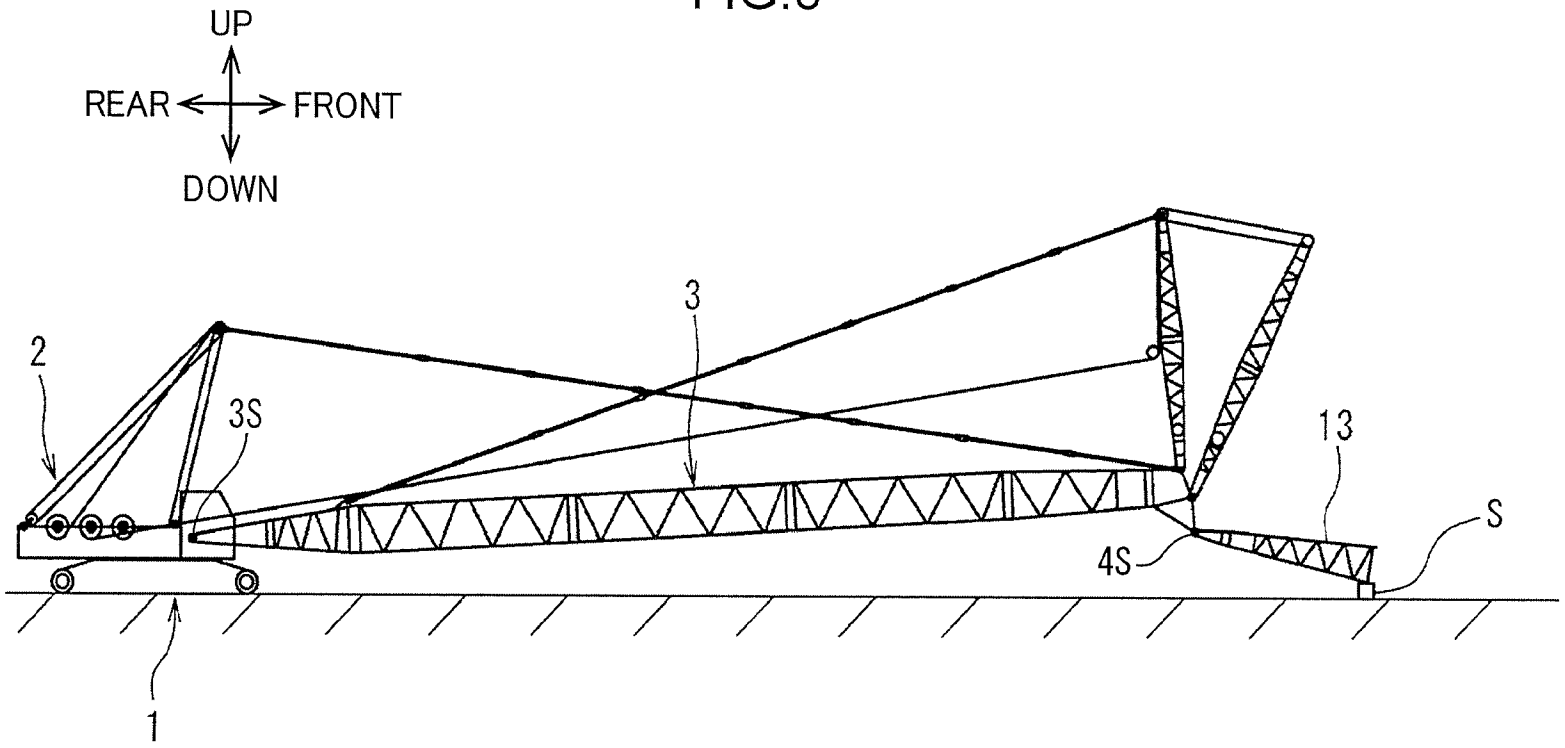
FIG. 6 is a side view schematically showing a step succeeding to the step shown in FIG. 5 of the crane assembling method of a crane according to one embodiment of the present invention.

Next, as shown in FIG. 6, the distal end of the lower jib 3 is lowered by reeling out the rope of the assembling crane AC so that the distal end of the lower jib 3 is placed on the pedestal S (pedestal) disposed on the ground. At this stage of the operation, a height of the pedestal S is selected such that a height of the back-side connector 16 (FIG. 2) on a distal end side of the lower jib 13 becomes greater than a height of the back-side connector 16 on a proximal end side of the lower jib 13 when the intermediate jib 14 ((n+1)th partial jib) is directly placed on the ground. Further, the distal end of the lower jib 13 may be directly disposed on the ground without using the pedestal S.

<Back-Side Connector Connecting Step>

Figure 7:
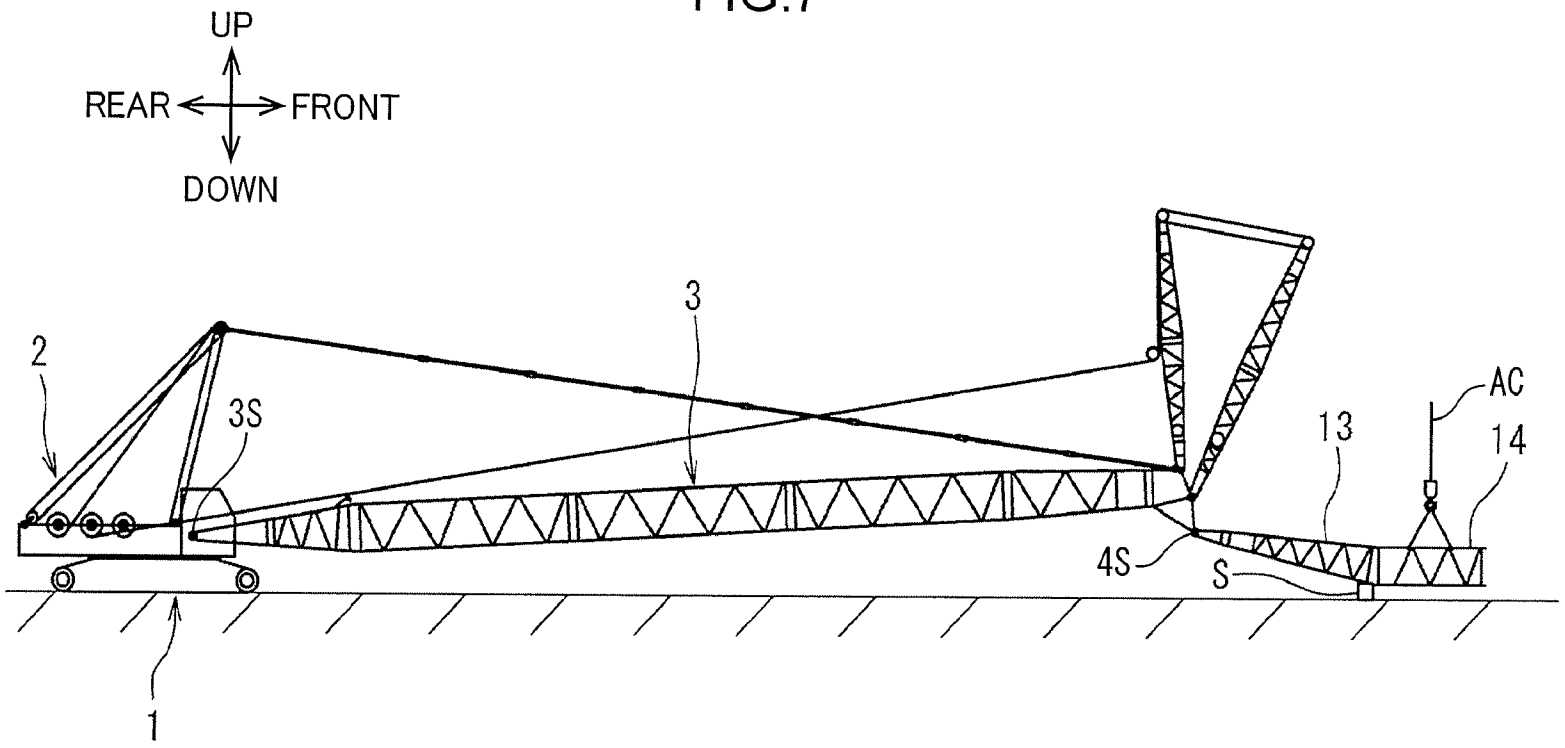
FIG. 7 is a side view schematically showing a step succeeding to the step shown in FIG. 6 of the crane assembling method of a crane according to one embodiment of the present invention.

In the back-side connector connecting step, as shown in FIG. 7, the intermediate jib 14 is moved near to the lower jib 13 by lifting the intermediate jib 14 using the assembling crane AC, and the back-side connector 16 of the intermediate jib 14 is aligned with the back-side connector 16 of the lower jib 13. By inserting the fixing pin 18 extending parallel to the rotary shaft of the jib foot 4S into the pin holes of both the back-side connectors 16 in such a state, the back-side connector 16 of the intermediate jib 14 is connected to the back-side connector 16 of the lower jib 13 in a relatively rotatable manner.

<Wheel Mounting Step>

Figure 8:
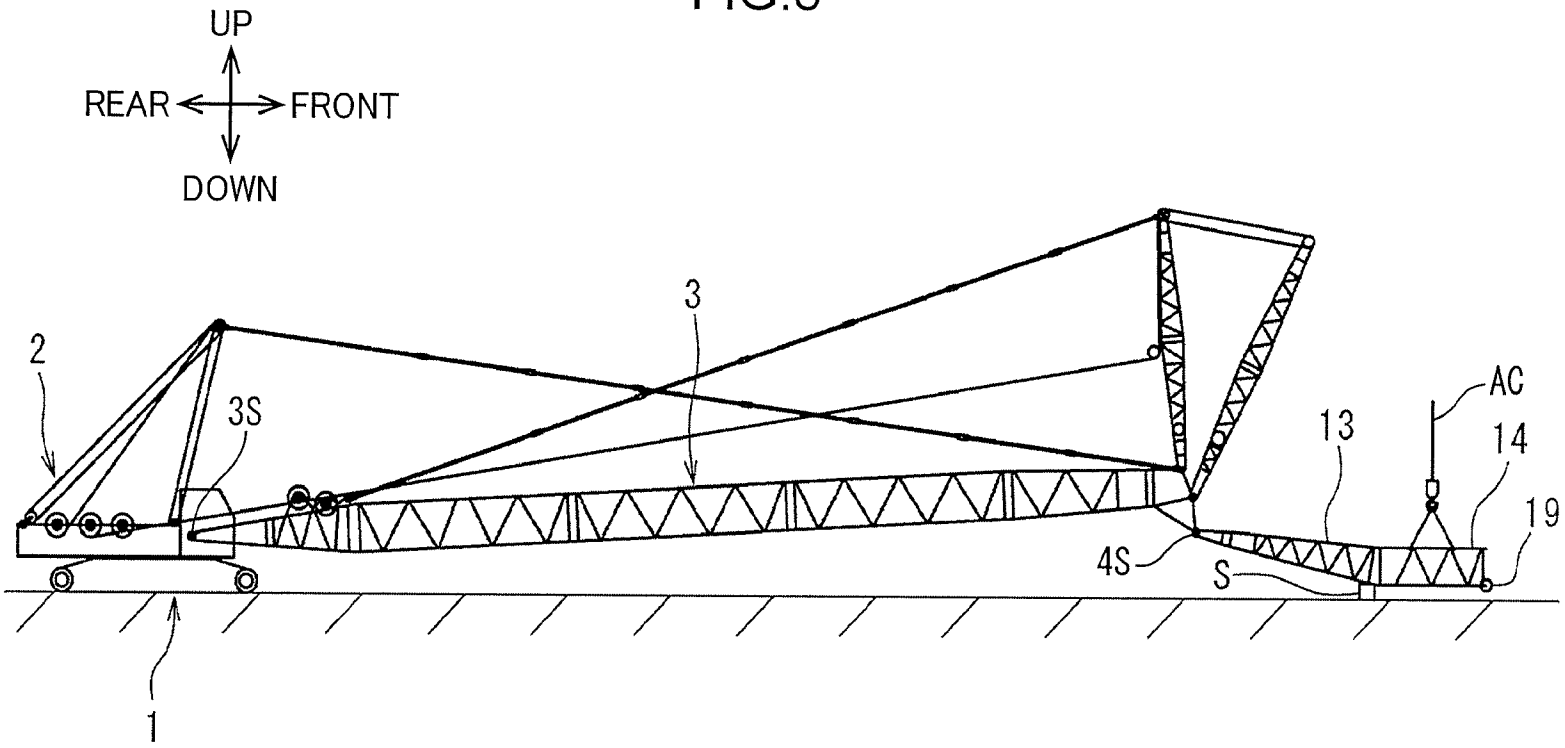
FIG. 8 is a side view schematically showing a step succeeding to the step shown in FIG. 7 of the crane assembling method of a crane according to one embodiment of the present invention.
Figure 9:
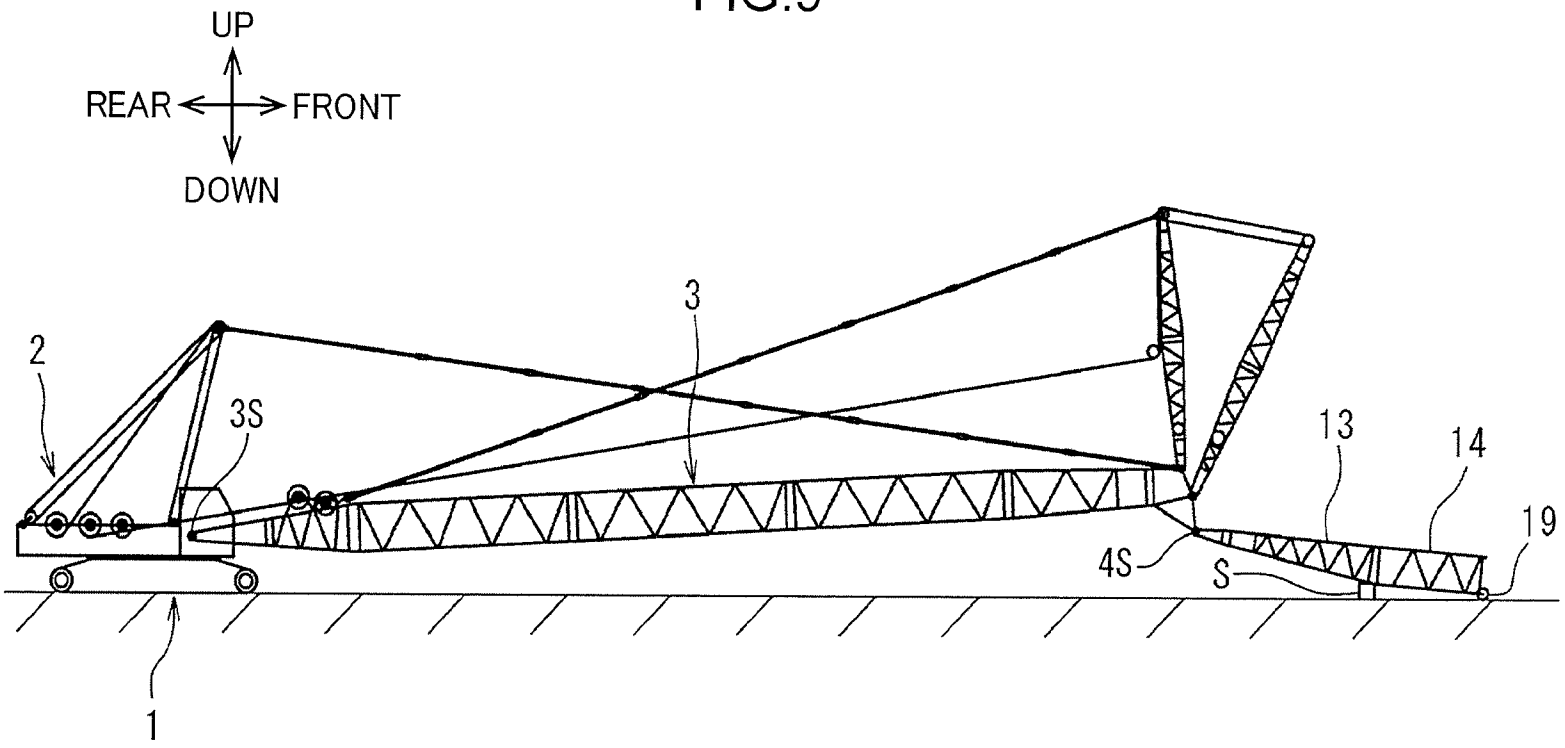
FIG. 9 is a side view schematically showing a step succeeding to the step shown in FIG. 8 of the crane assembling method of a crane according to one embodiment of the present invention.

In the wheel mounting step, as shown in FIG. 8, the wheel 19 is mounted on the front-side connector 17 on a distal end side of the intermediate jib 14 in a state where the intermediate jib 14 is lifted by the assembling crane AC. Then, as shown in FIG. 9, the rope of the assembling crane AC is reeled out so that the wheel 19 is brought into contact with the ground. That is, a weight on the distal end side of the intermediate jib 14 is supported by the wheel 19.

<Front-Side Connector Connecting Step>

Figure 10:
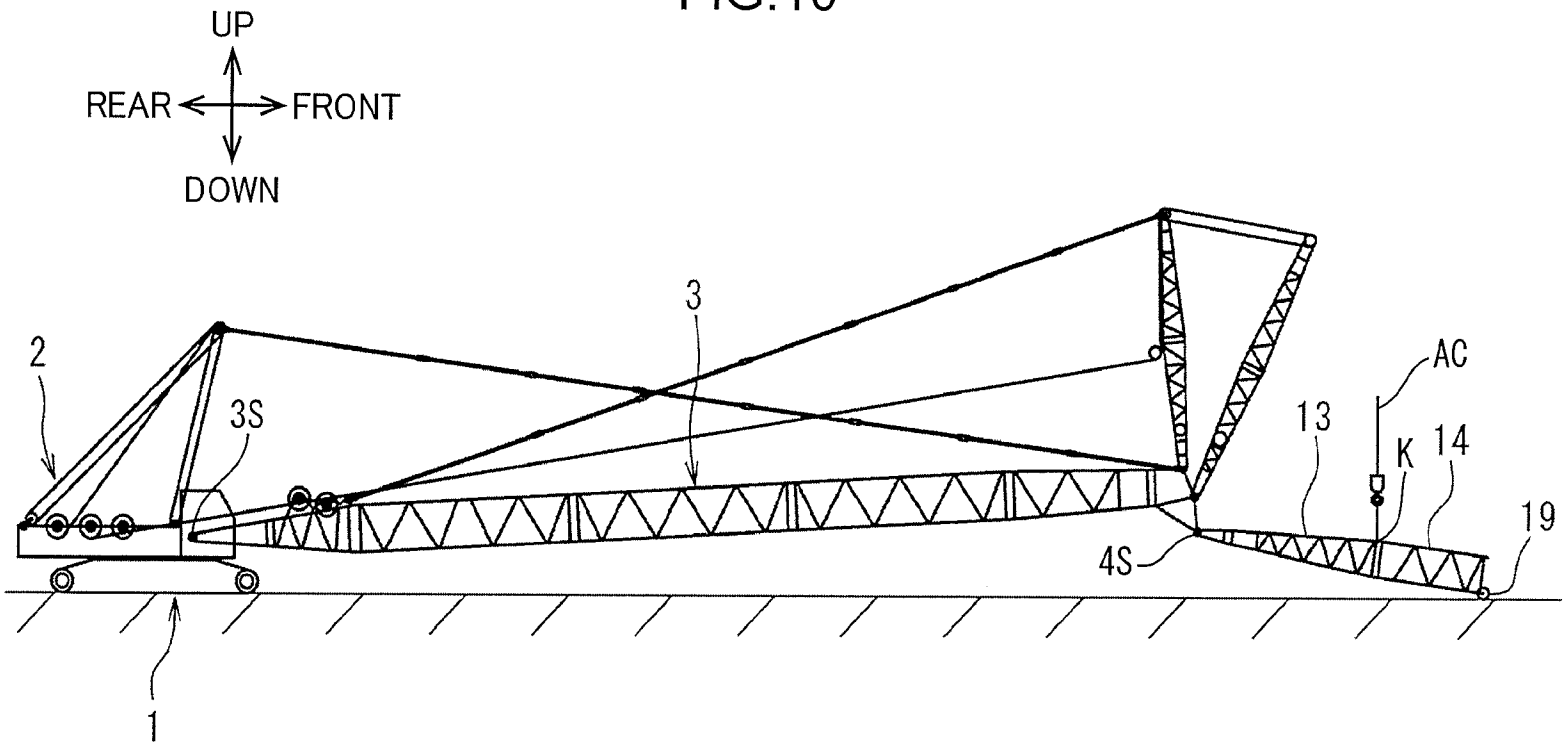
FIG. 10 is a side view schematically showing a step succeeding to the step shown in FIG. 9 of the crane assembling method of a crane according to one embodiment of the present invention.

In the front-side connector connecting step, as shown in FIG. 10, a portion of the lower jib 13 near the connecting portion between the lower jib 13 and the intermediate jib 14 is lifted using the assembling crane AC so that the lower jib 13 is tilted in a raising direction about the jib foot 4S disposed on the distal end of the boom 3. With such an operation, the back-side connector 16 on a proximal end side of the intermediate jib 14 is lifted and hence, the intermediate jib 14 is tilted in a lying-down direction using the fixing pin 18 inserted into the back-side connectors 16 of the lower jib 13 and the intermediate jib 14 as a fulcrum. With such an operation, the front-side connector 17 on the distal end side of the lower jib 13 and the front-side connector 17 on the proximal end side of the intermediate jib 14 are moved so as to overlap with each other (approach each other) about the above-mentioned fixing pin 18 inserted into the back-side connectors 16. By inserting another fixing pin 18 into both the pin hole of the front-side connector 17 on the distal end side of the lower jib 13 and the pin hole of the front-side connector 17 on the proximal end side of the intermediate jib 14 which overlap with each other in a penetrating manner, the intermediate jib 14 is fixed to the distal end of the lower jib 13.

At this stage of the operation, the back-side connector 16 on the proximal end side of the intermediate jib 14 is moved so as to draw an arc about the jib foot 4S on the distal end of the boom 3 and hence, the position of the distal end portion of the intermediate jib 14 is changed. However, the distal end portion of the intermediate jib 14 is supported by the wheel 19 and hence, the distal end portion of the intermediate jib 14 smoothly moves along the ground. Accordingly, the assembling operation can be facilitated and, at the same time, it is possible to prevent the distal end portion of the intermediate jib 14 from being damaged.

In the front-side connector connecting step, the proximal end side of the lower jib 13 may be lifted without lifting the portion of the lower jib 13 near the connecting portion between the lower jib 13 and the intermediate jib 14 using the assembling crane AC. By lifting the portion of the lower jib 13 near the connecting portion between the lower jib 13 and the intermediate jib 14, the front-side connector 17 disposed on a lower side portion of the proximal end of the intermediate jib 14 can be easily moved near to the front-side connector 17 disposed on the lower side portion of the distal end of the lower jib 13.

<Distal End Moving Step>

In the distal end moving step, as indicated by an arrow in FIG. 11, by raising the boom 3 using the boom foot 3S as a fulcrum, a proximal end portion of a connected body of the lower jib 13 and the intermediate jib 14 which are connected to the distal end of the boom 3 is lifted so that the distal end portion of the intermediate jib 14 is moved toward the upper turning body 2 side. At this stage of the operation, rolling of the wheel 19 on the ground is allowed.

Accordingly, at the time of repeating the above-mentioned intermediate jib connecting step for connecting the next intermediate jib 14 ((n+2)th partial jib) to a distal end of the intermediate jib 14 ((n+1)th partial jib) shown in FIG. 11, as shown in FIG. 12, a pedestal S is disposed at substantially the same position (near the above-mentioned position) in the placing step so that the distal end of the intermediate jib 14 ((n+1)th partial jib) can be placed on the pedestal S. That is, by performing the distal end moving step, it becomes unnecessary to largely change the arrangement of the assembling crane AC each time the intermediate jib connecting step is repeated. Accordingly, even when the assembling crane AC is a relatively small assembling crane, the assembling of the jib 4 can be performed while fixing the assembling crane AC at the same place. A height of the pedestal S may be suitably changed corresponding to a total length of the already mounted partial jibs.

When the jib 4 includes two or more intermediate jibs 14 (n≥2), the above-mentioned intermediate jib connecting step is repeated. In this case, the above-mentioned lower jib 13 forms the "first-stage intermediate jib 14", and the above-mentioned intermediate jib 14 forms the "second-stage intermediate jib 14". The wheel 19 is removed before the intermediate jib 14 shown in FIG. 12 is placed on the pedestal S, and is used in a repeated manner as the wheel 19 mounted on a distal end of the next intermediate jib 14 in the wheel mounting step for the next intermediate jib 14.

[Upper Jib Connecting Step]

Figure 13:
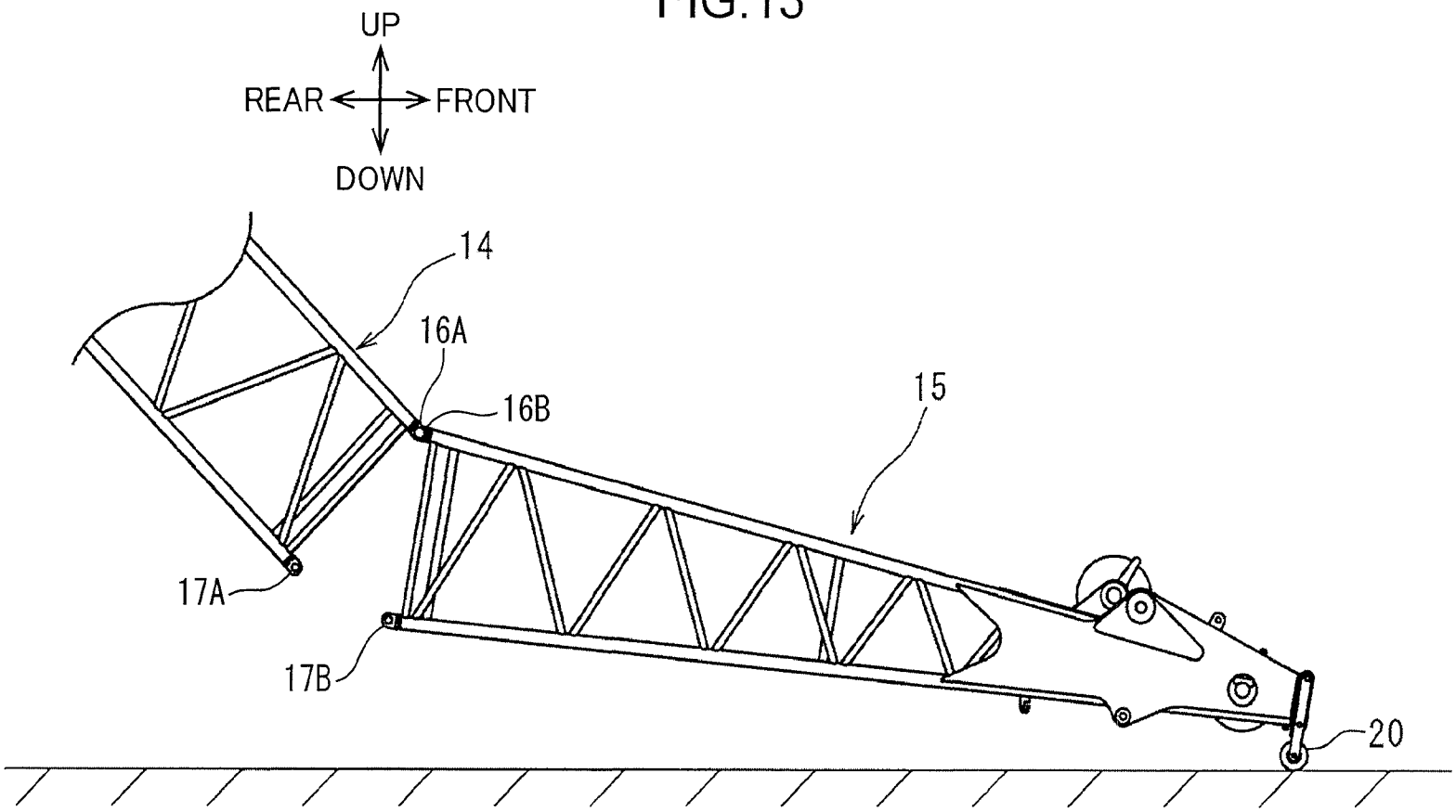
FIG. 13 is a side view schematically showing a mounting state of a wheel which is used in an upper jib connecting step of the crane assembling method of a crane according to one embodiment of the present invention.

The upper jib connecting step includes the steps of: placing a distal end of a most distal end intermediate jib 14 on a pedestal disposed on the ground in a state where the distal end of the boom 3 is separated from the ground <placing step>; connecting the back-side connector 16 on a proximal end side of the upper jib 15 to the back-side connector 16 on a distal end side of the most distal end intermediate jib 14 in a state where the upper jib 15 is suspended <back-side connector connecting step>; mounting a wheel 20 on a distal end portion of the upper jib 15 <wheel mounting step>; and connecting the front-side connector 17 on a distal end side of the most distal end intermediate jib 14 and the front-side connector 17 on a proximal end side of the upper jib 15 to each other <front-side connector connecting step>. FIG. 13 is a side view schematically showing a mounting state of the wheel 20 used in the upper jib connecting step in the crane assembling method of the crane 100 according to this embodiment.

The placing step, the back-side connector connecting step, the wheel mounting step, and the front-side connector connecting step in the upper jib connecting step can be performed substantially in the same order as the placing step, the back-side connector connecting step, the wheel mounting step, and the front-side connector connecting step in the intermediate jib connecting step except for a point that the wheel 20 different from the wheel 19 mounted on the front-side connector 17 is mounted on the distal end portion of the upper jib 15 as shown in FIG. 13 in the wheel mounting step, for example.

For mounting the wheel 20 on the distal end portion of the upper jib 15, a dedicated bracket or the like may be provided on a front side of the distal end portion of the upper jib 15, and a cart capable of supporting the distal end portion of the upper jib 15 may be used as the wheel 20. Further, the wheel 20 may be a wheel formed by mounting an adapter on the wheel 19 mounted on the front-side connector 17 for mounting the wheel on the distal end portion of the upper jib 15.

<Advantageous Effects>

According to this crane assembling method, as described above, by connecting the partial jibs one by one to the boom 3 and by raising the boom 3 corresponding to a total length of the partial jibs connected to the boom 3, a length of a necessary working space in the horizontal direction can be made small. That is, according to this crane assembling method, the crane 100 can be assembled even at a place whose length is smaller than a total length of the boom 3 and the jib 4.

According to this crane assembling method, by mounting the wheel 19 on the front-side connector 17 on a distal end side of a newly connected (n+1)th partial jib, the (n+1)th partial jib can be moved in a state where the distal end of the (n+1)th partial jib is kept in contact with the ground. Accordingly, it is unnecessary to lift up the distal end side of the (n+1)th partial jib at the time of connecting the front-side connector 17 of the nth partial jib and the front-side connector 17 on the proximal end side of the (n+1)th partial jib to each other and hence, an assembling operation can be facilitated and can be performed safely and, at the same time, the assembling operation can be performed using only one assembling crane.

The configuration of the crane 100 shown in FIG. 1 is the configuration of a general-use luffing jib crane. This crane assembling method does not require the crane 100 having the particular configuration, and it is sufficient to prepare the wheel 19 capable of being mounted on the front-side connector 17. Accordingly, the crane assembling method is widely applicable to assembling of a general-use luffing jib crane and hence, the crane assembling method has high general-purpose property.

Other Embodiments

The above-mentioned embodiment does not limit the configuration of the present invention. Accordingly, it should be construed that the above-mentioned embodiment can be modified by omission, replacement or addition of constitutional elements of respective parts of the embodiment based on the description of this specification and the common general technical knowledge, and all these modifications also fall within the scope of the present invention.

In the crane assembling method, a first partial jib may be a partial jib formed by connecting the lower jib and one or a plurality of intermediate jibs to each other, and the (n+1)th partial jib may be a connected body formed of a plurality of intermediate jibs.

According to the above-mentioned crane assembling method, in FIG. 9, the wheel 19 may be mounted on the front-side connector 17 on a distal end side of the intermediate jib 14 firstly and, thereafter, the back-side connector 16 on a proximal end side of the intermediate jib 14 may be connected to the back-side connector 16 on a distal end side of the lower jib 13. In this manner, in the case where the wheel 19 is mounted on the front-side connector 17 on the distal end side of the intermediate jib 14 firstly, the wheel 19 can be mounted on the front-side connector 17 in a state where the distal end side of the intermediate jib 14 is lifted by placing the intermediate jib 14 on another pedestal S or the like without lifting the intermediate jib 14 using the assembling crane AC.

In the placing step of the crane assembling method, provided that the back-side connector on a proximal end side of the (n+1)th partial jib can be connected to the back-side connector on a distal end side of the nth partial jib in the next back-side connector mounting step, the nth partial jib may be directly placed on the ground.

In the crane assembling method, plural sets of wheels may be used. With the use of the plural sets of wheels in this manner, the wheel can be mounted on the front-side connector 17 on a distal end side of the (n+2)th partial jib during a mounting operation of the (n+1)th partial jib and hence, an assembling operation can be performed smoothly.

In the crane assembling method, the distal end moving step may be performed before the front-side connector connecting step, or may be performed simultaneously with the front-side connector connecting step.

The crane assembling method is also applicable to assembling of a tower crane where a boom 3 is not raised or laid down during a period that the crane is used.

The crane assembling method according to the present invention is particularly preferably applicable to a large-sized luffing jib crane.

The present invention provides a crane assembling method of a crane, the crane including: a crane body; a boom which is disposed on the crane body such that the boom is capable of being raised or laid down about a first rotary shaft which is disposed horizontally; a jib which is connected to a distal end of the boom such that the jib is capable of being raised or laid down about a second rotary shaft which is disposed horizontally, the jib being formed by connecting a plurality of partial jibs to each other in a longitudinal direction. The crane assembling method includes a partial jib connecting step of connecting an (n+1)th partial jib to a distal end of an nth partial jib, where n is a natural number, in a state where the boom is mounted on the crane body and is laid down and n pieces of the partial jibs are connected to the distal end of the boom. The partial jib connecting step includes a placing step, an upper side connector connecting step, a wheel mounting step, and a lower side connector connecting step. In the placing step, the distal end of the boom is separated upward from a ground, and a distal end of the nth partial jib connected to the boom is placed on the ground or a pedestal disposed on the ground. In the upper side connector connecting step, the (n+1)th partial jib is lifted and is moved near to the nth partial jib, and an upper side connector disposed on an upper side (back-side) portion of a distal end of the nth partial jib and an upper side connector disposed on an upper side portion of a proximal end of the (n+1)th partial jib are connected to each other by a fixing pin which extends parallel to the second rotary shaft in a relatively rotatable manner. In the wheel mounting step, in a state where the (n+1)th partial jib is lifted, a wheel capable of rolling on the ground is mounted on a lower side connector disposed on a lower side (front-side) portion of a distal end of the (n+1) partial jib. In the lower side connector connecting step, the nth partial jib is lifted using the second rotary shaft as a fulcrum so that the (n+1)th partial jib is rotated relative to the nth partial jib about the fixing pin while allowing rolling of the wheel on the ground, the lower side connector disposed on the lower side portion of the proximal end of the (n+1)th partial jib is moved near to the lower side connector disposed on the lower side portion of the distal end of the nth partial jib, and the lower side connector on the distal end of the nth partial jib and the lower side connector on the proximal end of the (n+1)th partial jib are connected to each other.

In the above-mentioned configuration, the above-mentioned "back side" means a side disposed on an upper side in a state where the boom and the jib are extended and are laid down, and the above-mentioned "front-side" means a side disposed on a lower side in a state where the boom and the jib are laid down. Further, "distal end" means a side remote from the crane body (turning body) in a state where the boom and the jib are extended, and "proximal end" means a side near the crane body in a state where the boom and the jib are extended. Still further, "ground" means a surface of a steel plate or the like when curing is performed using a steel plate or the like.

According to the crane assembling method, by connecting the partial jibs one by one and by raising the boom corresponding to a total length of the connected partial jibs, a length of a necessary space in the horizontal direction can be made small. Further, according to the crane assembling method, by mounting the wheel on the lower side connector on the distal end of the newly connected (n+1)th partial jib, the (n+1)th partial jib can be moved in a state where the distal end of the (n+1)th partial jib is kept brought into contact with the ground. Accordingly, it is unnecessary to lift the distal end side of the (n+1)th partial jib in connecting the lower side connector of the nth partial jib and the lower side connector on the proximal end of the (n+1)th partial jib to each other and hence, the connecting operation of the partial jibs can be easily and safely performed. Further, the crane assembling method is applicable to assembling of an ordinary large-sized crane having a jib only by preparing a wheel capable of being mounted on the lower side connector and hence, the crane assembling method has the high general-purpose property.

In the lower side connector connecting step in the above-mentioned crane assembling method, it is preferable that the (n+1)th partial jib be rotated relative to the nth partial jib by lifting a portion of the nth partial jib near the connection portion between the nth partial jib and the (n+1)th partial jib.

With such a method, in the lower side connector connecting step, the lower side connector disposed on the lower side portion of the proximal end of the (n+1)th partial jib can be easily moved near to the lower side connector disposed on the lower side portion of the distal end of the nth partial jib.

It is more preferable that the above-mentioned crane assembling method further include a moving step of moving the distal end of the (n+1)th partial jib close to a position where the distal end of the nth partial jib is disposed in the upper side connector connecting step by raising the boom about the first rotary shaft while allowing rolling of the wheel on the ground after the lower side connector connecting step in the partial jib connecting step.

With such a method, a working area for connecting the (n+2)th partial jib becomes substantially equal to a working area used at the time of connecting the (n+1)th partial jib and hence, the crane can be assembled in a space having a relatively small distance in the horizontal direction and, at the same time, even when another assembling crane is relatively small so that a workable area of the assembling crane is small, it is unnecessary to largely move the assembling crane and hence, operation efficiency of the assembling operation of the crane can be enhanced.

It is preferable that a wheel having a wheel rotary shaft which is inserted into a pin hole formed in the lower side connector disposed on the distal end of the (n+1)th partial jib be prepared as the wheel, and the fixing pin be inserted into the pin hole of the lower side connector disposed on the distal end of the (n+1)th partial jib in the lower side connector connecting step in a step of connecting an (n+2)th partial jib to the distal end of the (n+1)th partial jib.

With such a method, the configuration of the wheel can be simplified and, at the same time, mounting of the wheel on the lower side connector can be facilitated and hence, operation efficiency of the crane assembling method can be enhanced. Further, the mounting position of the wheel and the connection position of the connector can be utilized in common and hence, it is unnecessary to form a large number of opening portions in the connector thus suppressing lowering of rigidity of the connector.

This application is based on Japanese Patent application No. 2017-242108 filed in Japan Patent Office on Dec. 18, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A crane assembling method of a crane, the crane including:

a crane body;

a boom which is disposed on the crane body such that the boom is capable of being raised or laid down about a first rotary shaft which is disposed horizontally; and a jib which is connected to a distal end of the boom such that the jib is capable of being raised or laid down about a second rotary shaft which is disposed horizontally, the jib being formed by connecting a plurality of partial jibs to each other in a longitudinal direction, the crane assembling method comprising:

a partial jib connecting step of connecting an (n+1)th partial jib to a distal end of an nth partial jib, where n is a natural number, in a state where the boom is mounted on the crane body and is laid down and n pieces of the partial jibs are connected to the distal end of the boom, wherein the partial jib connecting step includes:

a placing step of causing the distal end of the boom to be separated upward from a ground, and placing a distal end of the nth partial jib connected to the boom on the ground or a pedestal disposed on the ground;

an upper side connector connecting step of lifting the (n+1)th partial jib, moving the (n+1)th partial jib near to the nth partial jib, and connecting, by a fixing pin which extends parallel to the second rotary shaft, an upper side connector disposed on an upper side portion of a distal end of the nth partial jib and an upper side connector disposed on an upper side portion of a proximal end of the (n+1)th partial jib to each other in a relatively rotatable manner;

a wheel mounting step of mounting a wheel capable of rolling on the ground on a lower side connector disposed on a lower side portion of a distal end of the (n+1) partial jib in a state where the (n+1)th partial jib is lifted; and a lower side connector connecting step of lifting the nth partial jib using the second rotary shaft as a fulcrum so that the (n+1)th partial jib is rotated relative to the nth partial jib about the fixing pin while allowing rolling of the wheel on the ground, moving the lower side connector disposed on the lower side portion of the proximal end of the (n+1)th partial jib near to the lower side connector disposed on the lower side portion of the distal end of the nth partial jib, and connecting the lower side connector on the distal end of the nth partial jib and the lower side connector on the proximal end of the (n+1)th partial jib to each other.

2. The crane assembling method according to claim 1, wherein in the lower side connector connecting step, the (n+1)th partial jib is rotated relative to the nth partial jib by lifting a portion of the nth partial jib near the connection portion between the nth partial jib and the (n+1)th partial jib.

3. The crane assembling method according to claim 1, further comprising a moving step of moving the distal end of the (n+1)th partial jib close to a position where the distal end of the nth partial jib is disposed in the upper side connector connecting step by raising the boom about the first rotary shaft while allowing rolling of the wheel on the ground after the lower side connector connecting step in the partial jib connecting step.

4. The crane assembling method according to claim 1, wherein the wheel mounting step includes preparing the wheel by having a wheel rotary shaft inserted into a pin hole formed in the lower side connector disposed on the distal end of the (n+1)th partial jib, and the fixing pin is inserted into the pin hole of the lower side connector disposed on the distal end of the (n+1)th partial jib in the lower side connector connecting step in a step of connecting an (n+2)th partial jib to the distal end of the (n+1)th partial jib.

* * * * *